US005774924A

United States Patent [19]

Beckham et al.

[11] Patent Number: 5,774,924

[45] Date of Patent: Jul. 7, 1998

[54] ADJUSTABLE DRYWALL AND PLASTERING TOOL

[76] Inventors: Danny A. Beckham, 8530 SW 170th St., Archer, Fla. 32618; David W. Mitchell, P.O. Box 1823, High Springs, Fla. 32655-1823

[21] Appl. No.: 783,436

[22] Filed: Jan. 16, 1997

[51] Int. Cl.[6] ..... B05C 17/10

[52] U.S. Cl. ..... 15/235.7; 15/235.8; 425/458

[58] Field of Search ..... 15/235.7, 235.8; 425/458

[56] References Cited

U.S. PATENT DOCUMENTS

| | | | |
|---|---|---|---|
| 398,781 | 2/1889 | Hovey | 15/235.7 |
| 2,595,742 | 5/1952 | Wood, Jr. . | |
| 2,608,853 | 9/1952 | Schrepper . | |
| 3,373,458 | 3/1968 | Haivala | 15/235.7 |
| 4,619,013 | 10/1986 | Yon | 15/235.8 |
| 4,631,019 | 12/1986 | House | 425/458 |
| 4,669,970 | 6/1987 | Perry | 15/235.7 X |
| 4,757,572 | 7/1988 | Yon | 15/235.7 |
| 5,192,558 | 3/1993 | Sparrow et al. | 425/87 |
| 5,459,969 | 10/1995 | Stibolt et al. . | |
| 5,467,497 | 11/1995 | Greene et al. | 15/235.8 |
| 5,544,384 | 8/1996 | Forselius et al. | 15/235.7 |

*Primary Examiner*—Mark Spisich
*Attorney, Agent, or Firm*—Sven W. Hanson

[57] ABSTRACT

A cornering tool is provided which may be used for application of drywall or plaster or similar construction coating materials. The tool is adjustable over a wide range of corner angles. In addition, the adjustability allows for use in plastering as well as drywall application where the angle is offset to effect screeding of excess coating material. The tool includes the novel feature in such tools of a thinned hinge section with increased flexibility which allows for angular adjustment of the blades without bending the blades out of plane. The tool is preferably formed of plastic.

13 Claims, 2 Drawing Sheets

ADJUSTABLE DRYWALL AND PLASTERING TOOL

BACKGROUND OF THE INVENTION

This invention relates to hand tools used to apply or finish construction coating or finishing materials such as plaster and drywall cements. In particular, the invention is an adjustable tool for applying and finishing coating materials to wall corners. Most building construction coating and finishing materials are applied by hand. The hand tools used are specifically designed to apply the particular coating material and create the proper finished surface. Specialty tools have been developed to assist in making a proper finished corner. The corner junction where two walls intersect provide a particular challenge. A wet coating material must be applied to two flat surfaces simultaneously while creating a straight corner line at the intersection. Many tools are available for this purpose. An important feature of these tools is the ability to adjust to, and accommodate, variations in the corner angle. Variations of these tool are disclosed in U.S. Pat. Nos. 4,619,013 to Yon; 4,757,572 to Yon; 5,192,558 to Sparrow et al.; 2,595,742 to Wood; 2,608,853 to Schrepper; and 3,373,458 to Haivala. A common method of adjustment is to form two blades of a single piece of thin sheet metal folded along a straight line. Adjustment in use is made by further bending the blades, relative to each other, at the fold line. However, typically, these tools suffer from the same limitation. That is, the blades and fold have the same thickness and resistance to flexing. Consequently, it is impossible to make other than very minor adjustments without distorting the flatness of the two blades. In Sparrow et al, a more flexible material has been introduced in a tool to allow bending at the fold. However, there only relatively large radius corners are possible due to the thickness and softness of the blade materials taught.

In addition, application of drywall coatings differs from application of plaster in a distinct way in regards to the tools used. Drywall is applied with a tool having blades slightly offset from the angle of the corner to which the coating is being applied. This is to effect a screeding-off of excess material as the tool passes over the corner. A plastering corner tool, on the other hand, typically has blades which match the angle of the corner to which the coating is being applied. For this reason, those in the craft must have available multiple sets of tools to handle the different jobs.

What is needed is a general purpose corner tool which may be easily adjusted over a wide range of angles while maintaining the flatness of the blades. Such a tool should be adjustable for use in drywall and plaster and other coatings applications.

SUMMARY OF THE INVENTION

It is an objective of the invention to provide an adjustable cornering tool for application of a variety of coating materials.

It is another objective of the invention to provide a cornering tool which can be adjusted to match a wide range of corner angles.

It is a further objective to provide a plastic cornering tool which is safer in use and which will not rust and will be more easily cleaned than standard tools for the same purpose.

It is yet another objective of the invention to provide a cornering tool which has a highly flexible hinge section which allows adjustment without bending the blades out of planar shape.

The present invention is a cornering tool which utilizes a contiguous resilient hinge of high flexibility between a pair of blades. Many tools have been developed to provide adjustable blades in a tool for applying cementious coating materials to wall corners. Angular adjustment in many structures is typically provided through hinges. But typical hinges are not applicable to cornering tools due to the inherent disruption of the working surfaces. The working surfaces of a cornering tool must be smooth and uninterrupted to create a smooth surface on the coating material being applied or finished. Standard hinges with interlocking elements would create a working surface with interruptions or, at a minimum, joint lines. However, the present invention provides a unique continuous hinge section which provides the necessary flexibility while maintaining a smooth working surface. The preferred method to impart a high flexibility is to form the hinge section much thinner than the adjacent blades. The tool blades are allowed to move relative to each other without distortion from bending forces. A tool is provided which has transition sections of intermediate thickness between the blades and a very thin hinge section. This particular design allows for vary sharp angles which can be rebent multiple times without failure of the hinge section. The present cornering tool also provides support arms connected to support posts on the blades to maintain the desired position of the blades in use. An adjusting feature is provided in one configuration through a simple locking fastener. A tool handle is provided in a relative position which is ideal for providing the proper forces to the cornering tool while applying coating materials. The features of the claimed invention make it applicable for use in applying to inside and outside corners any of a variety of coating materials including those known in the art as stucco, sand finished plaster, driveit, stow, acrocrete, and concrete base.

DESCRIPTION OF THE PREFERRED EMBODIMENTS

Figure 1:
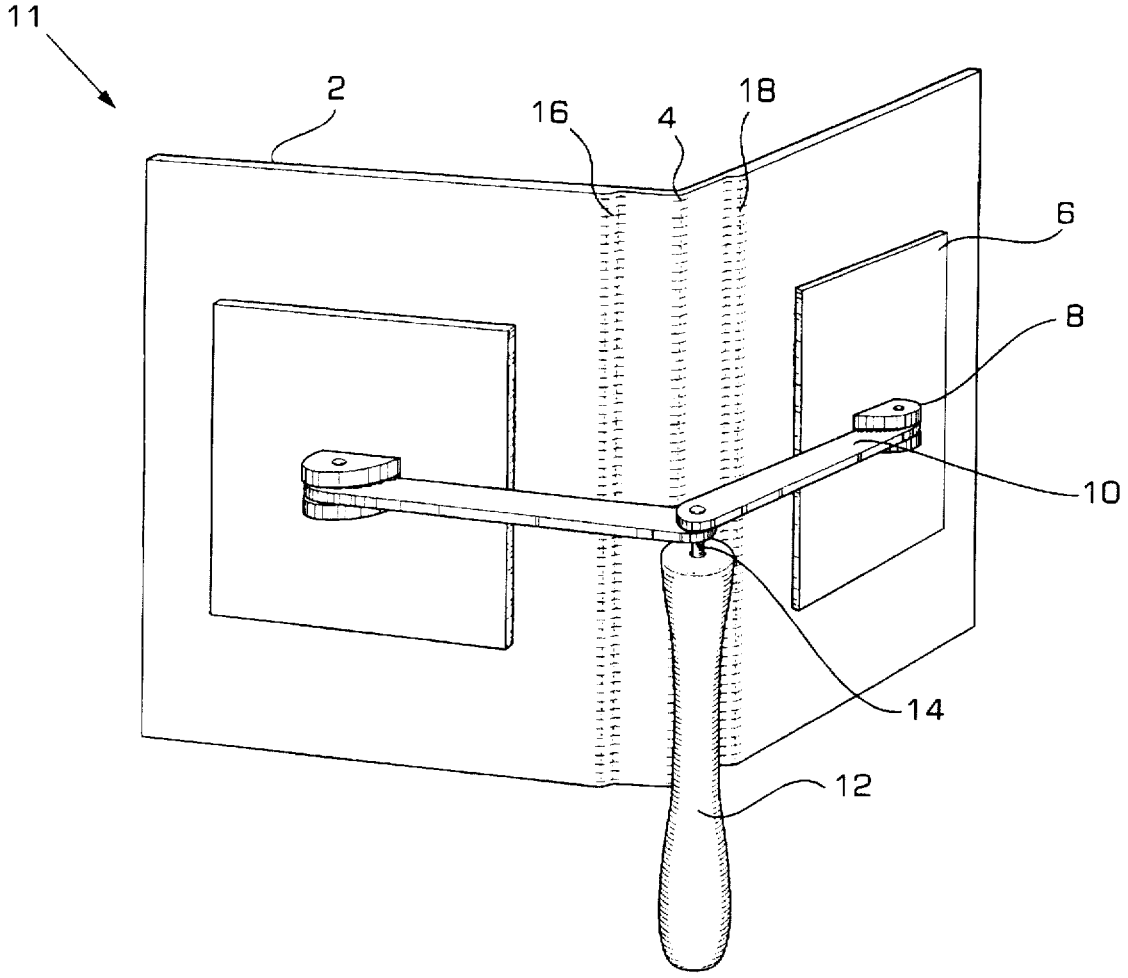
FIG. 1 is a perspective view of one embodiment of the invention.
Figure 2:
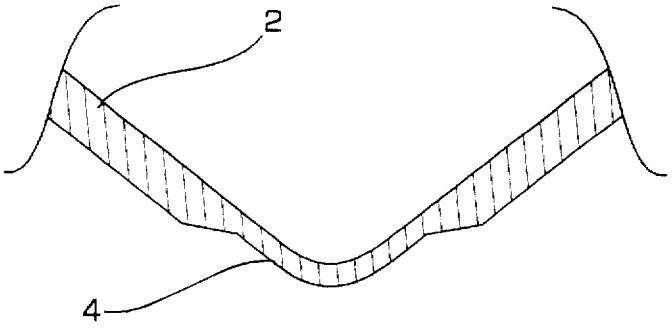
FIG. 2 is an enlarged view of the thinned hinge section of the tool shown in FIG. 1.

Cornering tools typically have two blades joined at adjacent edges along a common bend or fold line. Typically, the two blades are formed by bending a single piece of thin material such as thin sheet metal. The resulting bend defines the finished corner created by the tool in use. The present invention, now taught by the example shown in FIG. 1, is a cornering tool also having two blades 2. Each blade has a planar working surface which, in use, smooths the coating material onto the wall. Both blades have at least one straight edge (16 and 18, respectively). Interposed between these adjoining straight edges of the two blades is a hinge section 4. This hinge section 4 extends contiguously substantially the full length of the straight edges 16, 18. By contiguous, it is meant here that there are no intervening gaps or joints in the resultant surface. When the blades are bent, the hinge section is deformed into an approximately circular section, the radius of which depends on the width and thickness of the hinge section. A very narrow and thin section will result in a very small radius; while a greater width hinge section will form a larger radius. The particular dimensions are determined by the particular application for which the tool is to be used. In order to allow the two blades to be bent to form a wide range of angles while not appreciably deforming the blades, the hinge section must have a much greater flexibility than the blades themselves. The preferred method of obtaining an increased flexibility is to form the hinged section with a reduced thickness with respect to the blade thickness. One such hinge section is shown in FIG. 2. The thickness of the hinge section must be only a small fraction of the blade thickness to sufficiently limit the bending that occurs in the blades. The blades may be formed with a non-uniform thickness. In such cases, the blade "thickness" of interest herein is approximately an average thickness of the blade between the hinge and the connection of any support to the blade. Similarly, the hinge section thickness may vary over its width. What is important is that the hinge section thickness be sufficiently small over a sufficiently large proportion of the hinge section that the overall flexibility of the hinge section is appreciably greater than the blade flexibility.

Because the working surfaces of the blades shape the surface of the walls being finished, it is important that the intersections of the hinge section with the blade edges be smooth, contiguous, and without creases, pits, or joint lines. That is one reason that it is preferred that the blades and hinge section be formed from a single piece rather than of multiple, initially separate, pieces that are joined. To form the blades from a single piece, in a substantially rectangular piece of sheet material, a rectangular trough is formed, approximately centered, across the full width of the material. The trough width equals the hinge section width and the trough bottom thickness is the hinge section thickness. This trough can be formed by extrusion in the sheet material, by casting, or may be formed by removing material from a flat sheet, or any similar method. The sheet material is then bent symmetrically along the trough to form adjacent blades from the sheet material on either side of the trough. The blades are bent toward the trough side to form a tool for inside corners. To form a tool for outside corners, the blades are bent toward the working surface of the sheet material. In this manner, a continuous flat smooth working surface is always available to shape a coating material to the wall surfaces and corner. Less preferably, such a tool could be formed from separate blade and hinge pieces joined along the adjacent edges. However, a smooth working surface is not inherent in such a tool. While the preferred embodiment includes blades of flat uniform thickness, blades of varied thickness are also envisioned. A molded blade having considerable thickness is also contemplated. What is essential is that the blades have a flat and smooth working surface. It is known to those skilled in the art that the top edge of the blades should be angled to a peak at the hinge section to provide for proper application of coatings.

To support and maintain the blades in the desired relative position, a support structure is secured to both blades. In the embodiment of FIG. 1, the support structure consists of reinforcing pads 6, support posts 8, and support arms 10. The reinforcing pads 6 are secured to the backside of the blades from the working surfaces. The pads are preferably of a thickness at least approximating the blade thickness. The function of the reinforcing pads is to provide a base for the mounting of the support posts 8 and to distribute the forces transmitted, in use, to the blades. Where the blade is molded, the reinforcing pad may also be molded simply as a region of increased thickness. The reinforcing pads may be unnecessary if the blade thickness is sufficient. The support posts in the figure consist of a pair of posts extending perpendicularly from each of the reinforcing pads. The support posts, as well as the reinforcing pads, can be integrally formed with the blade such as in a molding, or formed separately and rigidly fixed to the blades. A support arm 10 end is captured between each pair of support posts. The support arms are pivotably fixed in that position by a rivet or other fastener passing through the respective support posts and through an oversized hole in each support arm end. It will be obvious to one skilled in the art to accomplish the same attachment function with any of a variety of different structural elements available in the technology. Both of the support arms include a hole in the support arm end distant from the support posts. A means of adjustment is provided by a threaded fastener rod 14 which is disposed through the distant hole in both support arms. This fastener rod is rigidly fixed in a handle 12 which is used to grasp the tool. By tightening a wingnut or similar fastener onto the fastener rod, over the support arm ends, the support arms may be locked into a particular desired angular position. In use, when adjustment of the blade angle is desired, the wingnut is loosened, the blades are bent into position, the support arms pivoting to follow the blade position, and the wingnut locked at the new position. More preferably, however, the handle contains internal threads or retains within it a threaded fastener. The threaded fastener rod 14 is then threaded into these threads such that loosening and tightening can be effected by simply rotating the handle. This has the advantage of removing the operating threads distant from the coating material being applied. The support arms are preferably formed of flat metal such as aluminum or stainless steel. Preferably the support arms are of equal length and the support posts symmetrically located on the respective blades. In this manner the handle will always be aligned symmetric with the hinge section providing for even loading of the blades in use. It is possible, by making the support arms of sufficient length, to have a tool which can be used for both inside and outside corners. This is accomplished by simply loosening the fastener on the support arms and flexing the blades from one configuration to the other. However, it has been found that such a tool inherently must have arms which are longer than optimum. Separate tools for each corner type is believed preferred in most situations.

It is preferred that the support posts, and reinforcing pads, be generally centrally located on the blades such that the handle subsequently extends below the lower edge of the blades. The appropriate size of the blades will be clear to one skilled in the art, but a preferred size has found to be approximately 3.5 inches wide by 5.5 inches high for each of the two opposing blades. It is preferred that the blades and hinge be formed from a sheet of plastic having a thickness of approximately ⅛ inches. Sheet polystyrene has been found to form a blade with a long lasting hinge section. Many similar plastics and plastic-like materials are available and known in the art for fabrication of parts requiring toughness and resistance to abrasion. An advantage of a plastic blade is a reduced potential for hand injuries. Typically, where blades are formed of sheet metal, cuts to the user's hand often occur particularly when the user reaches for the tool and accidentally hits a blade edge or corner. An additional advantage of the plastic blade is the ease by which it is cleaned and the absence of corrosion or rust inherent with many metallic tools.

Figure 3:
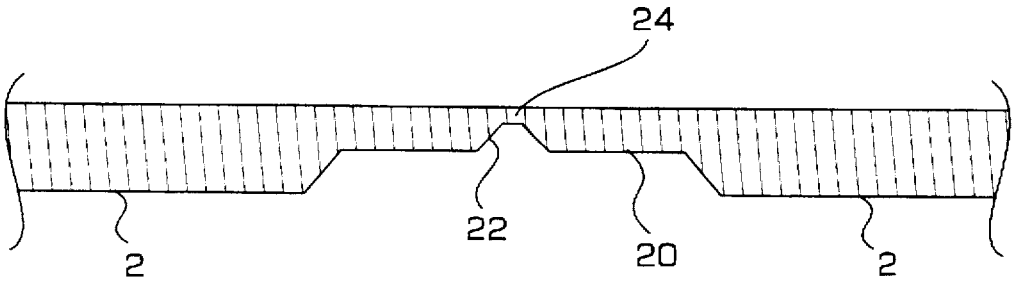
FIG. 3 is an enlarged view of a preferred configuration having lands on intermediate thickness.
Figure 4:
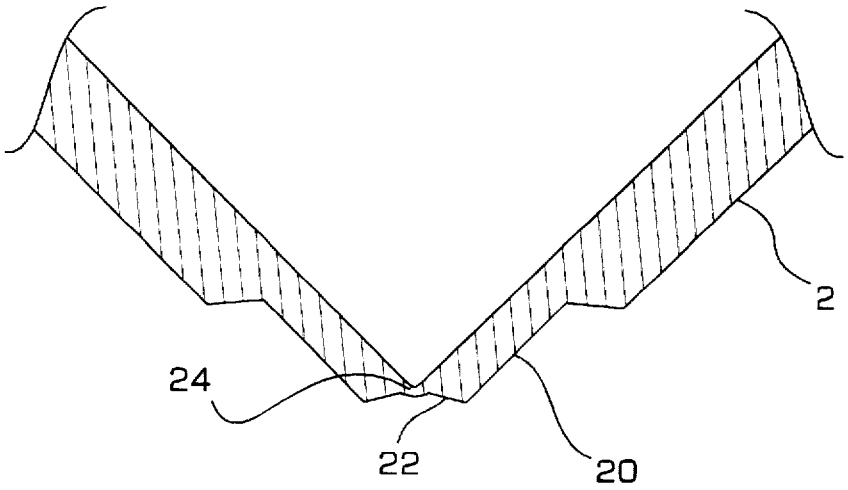
FIG. 4 is an enlarged view of the configuration of FIG. 3 bent to form an outside cornering tool.

In the finishing of coating materials such as drywall cement, it is often desired to create a very sharp finished corner, that is, a corner with a small radius of curvature. A tool with such a sharp corner, which is also adjustable, is susceptible to breaking along the bend line. In particular in a cornering tool using metal blades, when the metal is repeatedly bent, work hardening of the metal will eventually result in cracking and failure. While many plastics are not as susceptible to this cracking, a plastic cornering tool having a very sharp bend which undergoes repeated bending will also eventually fail. FIG. 3 depicts one hinge section configuration in a plastic blade which has been found to provide a very sharp corner which is highly adjustable but which is less susceptible to cracking of the hinge section 24. In order to form a sharp corner, the hinge section thickness is very small, preferably no more than 0.025 inches and more preferably about 0.015 inches. The hinge section 24 is also approximately as wide as the hinge is thick. Outward from the hinge section, a transition taper 22 extends to a transition land 20. The land 20 is preferably about 0.04 to 0.06 inches thick and has a width of 0.125 to 0.375 inches. The geometry of the hinge section, taper and land remains substantially constant over the full dimension of the blade. These numbers are most appropriate in the material polystyrene and variations may be necessary when using other materials. It has been found by using various geometries that introducing such a land with an intermediate thickness between the blade and hinge section thickness, located between the hinge section and the blade, increases the durability of the hinge section. In trials, a prototype having the above geometry underwent several hundred repeated bends of the hinge section without evidencing cracking. FIG. 4 shows the same geometry as that of FIG. 3 but in a bent orientation as for an outside corner tool. Note that the bending is substantially isolated to the hinge section thereby forming a very small radius bend. While it is possible to form a tool without a transition taper 22—having an abrupt shoulder between the hinge section and land instead—the taper also assists the blades to be bent to form an inside corner tool without interference of opposing lands or blades.

The scope of the claimed invention is not limited by the specific examples given in this specification. Modifications, including use of future materials and methods, will become obvious to one skilled in the art in light of the teachings herein. The novel features of this invention can be incorporated in other equivalent tools.

We claim:

1. An adjustable handtool for application of coating materials to corners, the tool comprising:

a first blade, a second blade, means for flexibly interconnecting said first blade to said second blade;

a handle; and means for adjustably supporting said first and second blades on said handle; said supporting means maintaining said handle in a plane symmetric with respect to said first and second blade;

means for locking said first blade relative to said second blade;

such that the blades may be easily adjusted in a wide range of relative angular positions without appreciably bending or distorting the blades while the handle is retained in a central position to naturally transmit pressure equally to the two blades.

2. The tool according to claim 1 wherein:

said supporting means comprises:

a first and second support arm, each support arm having:

a blade end and a lock end, and a common length from said blade end to said lock end, and each support arm being rotatably connected to one blade at said blade end and rotatably connected to said handle at said lock end.

3. The tool according to claim 2 wherein:

said first and said second blade are formed of a plastic material; and said supporting means includes a pair of reinforcing pads; each of said reinforcing pads being disposed on one of said blades functionally between said blade and its respective support arm, and each said reinforcing pad being of sufficient thickness to appreciably stiffen the respective blade.

4. The tool according to claim 3 wherein:

said first blade has a first thickness;

said second blade has a second thickness;

said reinforcing pads each having a thickness at least as great as said first and said second blade thickness; and wherein said flexible interconnecting means comprises:

a reduced thickness hinge, said hinge being interposed between said first and second blade, and said hinge having a hinge thickness, said hinge thickness being significantly less than said first or said second thickness.

5. The tool according to claim 4 wherein said reduced thickness hinge is contiguously integral with said first and second blade.

6. The tool according to claim 5, wherein said hinge thickness is in the range of about 0.015 to 0.03 inches.

7. An adjustable handtool for application of coating materials to corners, the tool comprising:

a first blade; said first blade having a first thickness;

a second blade; said second blade having a second thickness;

means for flexibly interconnecting said first blade to said second blade, said flexible interconnecting means comprising:

a reduced thickness hinge, said hinge being interposed between said first and second blade, and said hinge having a hinge thickness, said hinge thickness being significantly less than said first or said second thickness;

a handle;

means for adjustably supporting said first and second blades on said handle;

two lands, one of said lands being interposed between said hinge and each of said blades, respectively, and said lands both having a thickness less than said first or second blade thickness and greater than said hinge thickness;

such that the blades may be easily adjusted in a wide range of relative angular positions without appreciably bending or distorting the blades.

8. The tool according to claim 7 wherein:

said adjustably supporting means comprises:

a first support arm, said first arm having a blade end and a lock end, said first arm pivotably connected at said first arm blade end to said first blade; and a second support arm, said second arm having a blade end and a lock end, said second arm being pivotably connected at said second arm blade end to said second blade;

said first arm and said second arm being pivotably and lockably connected at said lock ends to said handle.

9. The tool according to claim 8, wherein:

said first arm has a lock hole located at said first lock end;

said second arm has a lock hole located at said second lock end;

said handle comprises a threaded rod and a threaded fastener; and said threaded rod is disposed through said first arm and said second arm lock holes, and said arms are thereon lockably captured by said threaded fastener.

10. The tool according to claim 9, wherein:

each of said blades has a reinforcing pad, each said reinforcing pad being of sufficient thickness to appreciably stiffen the respective blade.

11. An adjustable handtool for application of coating materials to corners, the tool comprising:

a first blade and a second blade; each of said blades being formed of plastic and having:

a centrally located reinforcing pad, said pad being of sufficient thickness to appreciably stiffen the blade, a support arm rotatably connected to said reinforcing pad, said support arm having a locking end and having a common length;

a reduced thickness hinge interposed between said first and said second blade, said hinge having a width extending from blade to blade and having a thickness;

a handle connected to both first and second blade support arm and disposed symmetrically between said first and said second blade.

12. The tool according to claim 11, wherein:

said hinge width is approximately equal said hinge thickness.

13. The tool according to claim 12, wherein:

said hinge thickness is in the range of about 0.015 to 0.03 inches.

* * * * *